US011248891B2

(12) United States Patent
Koontz et al.

(10) Patent No.: US 11,248,891 B2
(45) Date of Patent: Feb. 15, 2022

(54) ORDNANCE BALLISTICS DEPLOYMENT SYSTEM

(71) Applicant: Insights International Holdings, LLC, Newsoms, VA (US)

(72) Inventors: Greg Koontz, Franklin, VA (US); Evan Parker, Newsoms, VA (US); Neil Brennan, Newport News, VA (US); William Pocan, Chesapeake, VA (US)

(73) Assignee: Insights International Holdings, LLC, Franklin, VA (US)

( * ) Notice: Subject to any disclaimer, the term of this patent is extended or adjusted under 35 U.S.C. 154(b) by 62 days.

(21) Appl. No.: 16/900,226

(22) Filed: Jun. 12, 2020

(65) Prior Publication Data

US 2021/0285748 A1 Sep. 16, 2021

Related U.S. Application Data

(60) Provisional application No. 62/860,639, filed on Jun. 12, 2019.

(51) Int. Cl.
*F42B 12/36* (2006.01)
*F42B 12/34* (2006.01)

(52) U.S. Cl.
CPC ..... *F42B 12/365* (2013.01)

(58) Field of Classification Search
CPC ..... F42B 12/36; F42B 12/365; F42B 12/367; F42B 12/34; F42B 12/24; F42B 12/22; F42B 7/08; F42B 15/08
See application file for complete search history.

(56) References Cited

U.S. PATENT DOCUMENTS 1,023,469 A * 4/1912 Haslett ..... F42B 12/34 102/510
1,493,614 A * 5/1924 Dickerman ..... F42B 12/34 102/510
1,556,160 A * 10/1925 Riggs ..... F42B 12/34 102/510
3,097,603 A * 7/1963 Harper ..... F42B 12/34 102/506
3,427,976 A * 2/1969 Lucy ..... F42B 12/34 102/507
3,429,263 A * 2/1969 Lont ..... F42B 12/40 102/513
4,612,860 A * 9/1986 Flatau ..... F42B 12/06 102/364
4,730,236 A * 3/1988 Heinemeyer ..... F42B 39/00 174/521
4,776,279 A * 10/1988 Pejsa ..... F42B 12/34 102/510

(Continued)

*Primary Examiner* — Derrick R Morgan
(74) *Attorney, Agent, or Firm* — Fish IP Law, LLP

(57) ABSTRACT

An electronics ordnance delivery system that has an electronics component encased within a potting material, which itself is within a housing exoskeleton. A deceleration sleeve receives the exoskeleton, and is designed to shear away during a bullet's entry into a target body such that the electronics component is successfully deployed and remains in the target even if a part of the bullet exits the target. The system also includes an outer jacket that is also designed to shear away. The system can include a core that assists in the deployment of the electronics ordnance within the target.

13 Claims, 6 Drawing Sheets

(56) References Cited

U.S. PATENT DOCUMENTS 4,940,245 A 7/1990 Bittle
4,976,442 A * 12/1990 Treadway ..... F42B 12/385 473/570
5,094,463 A 3/1992 Dryden
5,153,368 A * 10/1992 Fogle, Jr. ..... F42B 3/188 102/202.2
5,381,445 A * 1/1995 Hershey ..... F42B 12/36 102/211
5,565,649 A * 10/1996 Tougeron ..... F42B 12/36 102/370
5,817,970 A * 10/1998 Feierlein ..... F42B 12/36 102/502
5,856,631 A 1/1999 Julien
6,024,021 A * 2/2000 Schultz ..... F42B 12/74 102/506
6,182,574 B1 * 2/2001 Giannoni ..... F42B 12/34 102/510
6,311,623 B1 * 11/2001 Zaruba ..... F42B 6/04 102/371
6,456,240 B1 * 9/2002 Cesulka ..... F41G 7/226 244/3.1
6,776,101 B1 * 8/2004 Pickard ..... F42B 12/34 102/507
7,300,367 B1 11/2007 Andol
7,426,888 B2 * 9/2008 Hunt ..... F42B 6/04 102/513
7,475,637 B2 * 1/2009 Rastegar ..... F42B 12/365 102/502
7,549,376 B1 * 6/2009 Grossman ..... F42B 10/50 102/400
7,581,501 B1 * 9/2009 Boone ..... F42B 10/06 102/214
7,631,833 B1 12/2009 Ghaleb
8,075,430 B1 * 12/2011 Hester ..... F42B 12/385 473/578
8,110,784 B2 * 2/2012 Rastegar ..... F42B 12/382 244/3.1
8,398,560 B2 3/2013 Elser
8,446,319 B2 * 5/2013 Parker ..... F42B 12/385 342/385
8,607,707 B1 * 12/2013 Arnon ..... F42B 30/02 102/439
9,151,582 B2 * 10/2015 Scott ..... F42B 12/36
9,255,775 B1 * 2/2016 Rubin ..... F42B 12/34
9,377,278 B2 * 6/2016 Rubin ..... F42B 12/40
9,631,910 B2 * 4/2017 Fricke ..... F42B 12/34
9,921,040 B2 * 3/2018 Rubin ..... F42B 12/367
10,082,376 B1 * 9/2018 Thomas ..... F42B 12/78
10,119,798 B2 11/2018 Parker
10,378,867 B2 * 8/2019 Couch ..... F42B 12/74
10,495,429 B2 * 12/2019 Omonira ..... F42B 12/54
10,670,379 B2 * 6/2020 Rubin ..... F42B 5/02
10,742,307 B2 * 8/2020 Brown ..... B64C 39/024
10,798,272 B2 * 10/2020 Choi ..... F42B 15/08
10,890,424 B2 * 1/2021 Omonira ..... F42B 12/36
2002/0010390 A1 1/2002 Guice
2002/0088367 A1 * 7/2002 MacAleese ..... F42C 13/02 102/502
2003/0089264 A1 * 5/2003 Eberhart ..... F42B 12/74 102/510
2003/0159612 A1 * 8/2003 Ziemack ..... F42B 12/54 102/512
2003/0229383 A1 12/2003 Whitehurst
2004/0069176 A1 * 4/2004 Kellner ..... F42B 12/204 102/476
2005/0241523 A1 * 11/2005 Schikora ..... F42B 12/34 102/510
2006/0005733 A1 * 1/2006 Rastegar ..... F42B 12/365 102/513
2006/0097882 A1 5/2006 Brinkerhoff
2006/0124022 A1 * 6/2006 Eberhart ..... F42B 12/34 102/508
2006/0142820 A1 6/2006 Von Arx
2006/0213105 A1 * 9/2006 Cugliari ..... F42B 12/365 42/1.01
2009/0002188 A1 1/2009 Greenberg
2010/0035709 A1 2/2010 Russell
2010/0117906 A1 5/2010 Miller
2011/0057042 A1 3/2011 Duggan
2011/0100201 A1 * 5/2011 Bass ..... H04B 7/18502 89/1.11
2011/0148884 A1 6/2011 Zeleny
2012/0180686 A1 * 7/2012 Jones ..... F42B 10/26 102/365
2012/0272855 A1 * 11/2012 Rebar ..... F42B 12/34 102/517
2014/0261045 A1 * 9/2014 Scott ..... F42B 12/54 102/502
2015/0268017 A1 * 9/2015 Diemer ..... F42B 12/36 102/439
2016/0161232 A1 * 6/2016 Rubin ..... F42B 12/54 102/439
2016/0313100 A1 * 10/2016 Balzano ..... F42B 12/34
2017/0061748 A1 * 3/2017 Graham ..... G01S 1/02
2017/0176156 A1 * 6/2017 Rubin ..... F42B 12/60
2017/0234664 A1 * 8/2017 Golloher ..... F42B 12/34 102/510
2017/0336185 A1 * 11/2017 Parker ..... F42B 12/365
2018/0359020 A1 * 12/2018 Brown ..... F42B 12/365
2019/0316888 A1 * 10/2019 Thielen ..... F42B 12/78
2020/0373997 A1 * 11/2020 Brown ..... H04B 7/18502
2021/0063129 A1 * 3/2021 Parker ..... H04Q 9/00
2021/0095940 A1 * 4/2021 Pedicini ..... F42C 17/04
2021/0180927 A1 * 6/2021 Agazim ..... F42B 12/06

* cited by examiner

ORDNANCE BALLISTICS DEPLOYMENT SYSTEM

This application claims priority to U.S. provisional application 62/860,639, filed Jun. 12, 2019. U.S. provisional application 62/860,639 and all other extrinsic references contained herein are incorporated by reference in their entirety.

FIELD OF THE INVENTION

The field of the invention is ordnance deployment systems.

BACKGROUND

The background description includes information that may be useful in understanding the present invention. It is not an admission that any of the information provided herein is prior art or relevant to the presently claimed invention, or that any publication specifically or implicitly referenced is prior art.

Until now, attempts have been made to incorporate sensors and other types of electronics packages into bullets, especially for small arms. However, up until now, those efforts were unsuccessful due to the high g-loads and harsh impacts of the environments. Firing a bullet exerts tremendous amounts of forces, heat, and other environmental factors on the bullet and the contents of the bullet therein. Upon impact, the effect can be even worse, depending on the density of the target. For delicate electronics components such as sensors, transmitters, processors and circuit boards, these forces can be destructive and often result in rendering the electronics components inoperable.

Moreover, an additional challenge in deploying electronics packages within bullets has been successfully retaining the electronics components embedded within the target, even in situations where part of the cartridge exists the target.

Thus, there is still a need for a solution that successfully deploys and maintains electronics components in ballistics and ordnance within a target while protecting the sensitive electronics package contained therein.

SUMMARY OF THE INVENTION

The inventive subject matter provides apparatus, systems and methods in which an electronic ordnance delivery system includes an electronics component encased within a potting material. A housing exoskeleton is dimensioned to receive the electronics component within the potting material, and a deceleration sleeve receives the housing exoskeleton.

The deceleration sleeve has several grooves along the sides that extend rearwardly that, upon entry into a target, are caused to shear away to deploy the electronics component within a target.

The electronics ordnance delivery system can also include an outer jacket that receives the deceleration sleeve. The outer jacket has serrated sides that also shear away upon entry into a target body.

In embodiments, the ordnance delivery system also includes a core at the front end of the deceleration sleeve. The core can be a lead core, and can have a rounded tip shape, a hollow-point tip shape, a flat-tip shape, or other shape.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
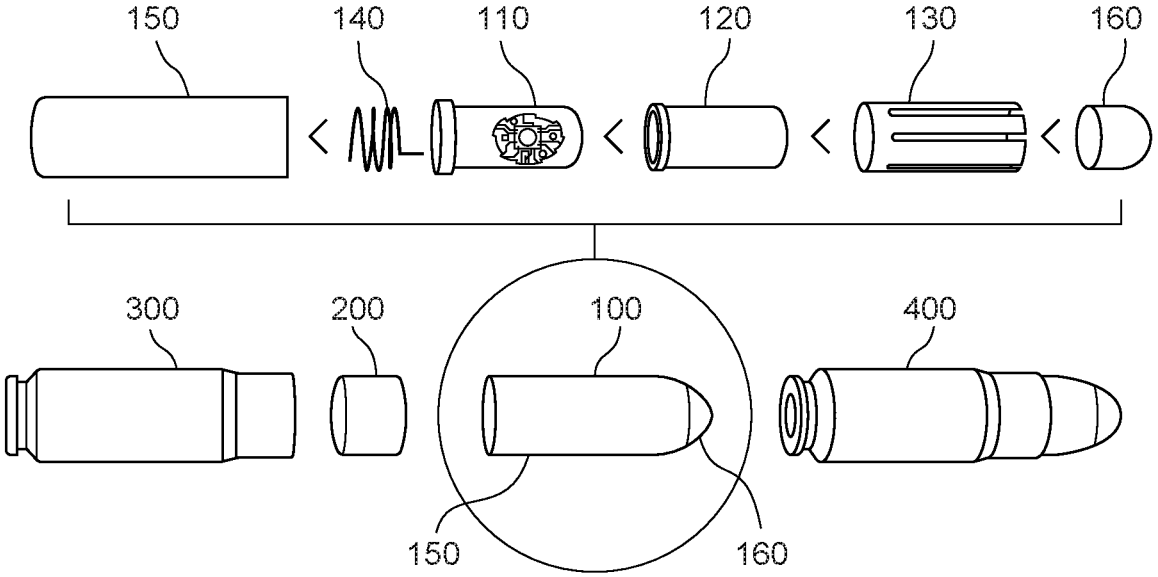
FIG. 1 illustrates the components of a bullet in an exploded and assembled view, according to an embodiment of the inventive subject matter

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows the components of bullet 100 in an exploded and assembled view, according to an embodiment of the inventive subject matter.

Bullet 100 includes an electronics component 110 which is enclosed within the housing exoskeleton 120 when the bullet is assembled. In the embodiment shown in FIG. 1, the electronics component 110 includes a transmitter and as such, is coupled to antenna 140 for signal transmission. As assembled, a core 160 is inserted into a first end of the deceleration sleeve 130. The core 160 is made of a material that deforms upon impact and entry into a target body. For example, core 160 can be a lead core or made from another suitable material (e.g., polymer, composite, copper, steel or other hard or soft metals).

The deceleration sleeve 130 encases the housing exoskeleton 120 which contains the electronics component 110, all of which are encased within the outer jacket 150. The outer jacket 150 is then incorporated to finish the assembly of bullet 100. However, it should be noted that in the assembled bullet the tip of core 160 is exposed and not completely enveloped by the outer jacket 150. This is visible from in FIG. 1.

As seen in FIG. 1, bullet 100, powder charge 200 and case and primer 300 are then assembled into the finished cartridge 400.

The electronics component 110 can be a tracking device designed to track the location of the device when active (e.g., GPS device or other location determination system). It typically includes a transmitter that can transmit data to a remote computer, such as to communicate the location data and other types of data. The electronics component 110 can also include components such as biomonitors (that can monitor biometric aspects of a target such as heartbeat, temperature, the type of target hit, etc.), microphones, etc. Typically, in addition to having hardware for the specific purpose(s) of the bullet 100 (e.g., sensors, transmitters, etc.) the electronics component 110 will include a processor and physical memory (e.g., RAM, ROM, flash memory, solid-state memory, etc.) that store the programming for the electronics component 110 to execute its functions. The electronics component 110 also includes a battery or other type of portable power supply to power the various parts of the electronics component 110.

The electronics component 110 shown in FIG. 1 is encased in a potting material that is shaped to fit within the housing exoskeleton 120. To encase the electronics component 110, the electronics component 110 is placed within a mold and the potting material then poured into the mold, enveloping the electronics component 110. The potting material then hardens around the electronics component 110 leaving the assembled electronics component 110 with the potting material in the proper shape to fit within the housing exoskeleton 120. Alternatively, the electronics component 110 can be placed within the housing exoskeleton 120 and the potting material poured into the exoskeleton 120 directly such that the potting material encases the electronics component and hardens in the shape of the inside of the exoskeleton 120.

The potting material can be a polymer or other material that can be shaped in this way. The electronics component 110 is seen in FIG. 1 inside the potting material for illustrative purposes. The potting material may be transparent or translucent, such that the electronics component 110 is visible, or it may be opaque such that the electronics component 110 inside is not visible.

The embodiment in FIG. 1 shows an antenna 140 that is external to the electronics component 110. The antenna 140 enables wireless communication to/from the electronics component 110 across various wireless communications technologies (e.g., WiFi, cellular communication along various spectrums (e.g., 4G, 5G, etc.), RF, Bluetooth, NFC, etc.).

It is contemplated that the electronics component 110 could have an internal antenna in addition to/instead of the external antenna 140. Having an internal antenna in addition to the external antenna 140 can provide the electronics component 110 with additional wireless communication modalities, and can allow for simultaneous data transmission among these modalities. For example, the external antenna 140 can be a long range RF antenna while the internal antenna could be a short-range antenna such as a Bluetooth or NFC antenna. Another benefit of having both an internal and external antenna is that, during deployment, the external antenna may become damaged. If this occurs, the internal antenna (which could be of the same or a different wireless technology) serves to provide a backup way for the electronics component 110 to transmit/receive data.

It is contemplated that the electronics component 110 can communicate with cellular towers, satellites, repeaters, networking devices, mobile devices, and other computer devices. Thus, the electronics component 110 can communicate directly with a controller's computing device or relay the signal indirectly via various types of communication technologies.

In embodiments, the electronics component 110 can communicate with other electronics components 110 of other bullets 100, forming an ad-hoc mesh wireless network. This can be used to relay a more complete representation of a situation to the controller's computing device. This can also be used to relay the signal from one or more bullets 100 back to the controller's computing device. For example, a series of bullets 100 can be fired at various locations near the intended target at distances such that each bullet 100 is within communication range of two other bullets in a chain, such that the series of bullets 100 forms a communication chain that leads from the intended target back within communication range of the operator. In this way, the operator (which could also be the shooter) could track the location of the target with a cellphone or other small portable device that might only have short-range wireless communications capabilities.

Figure 2:
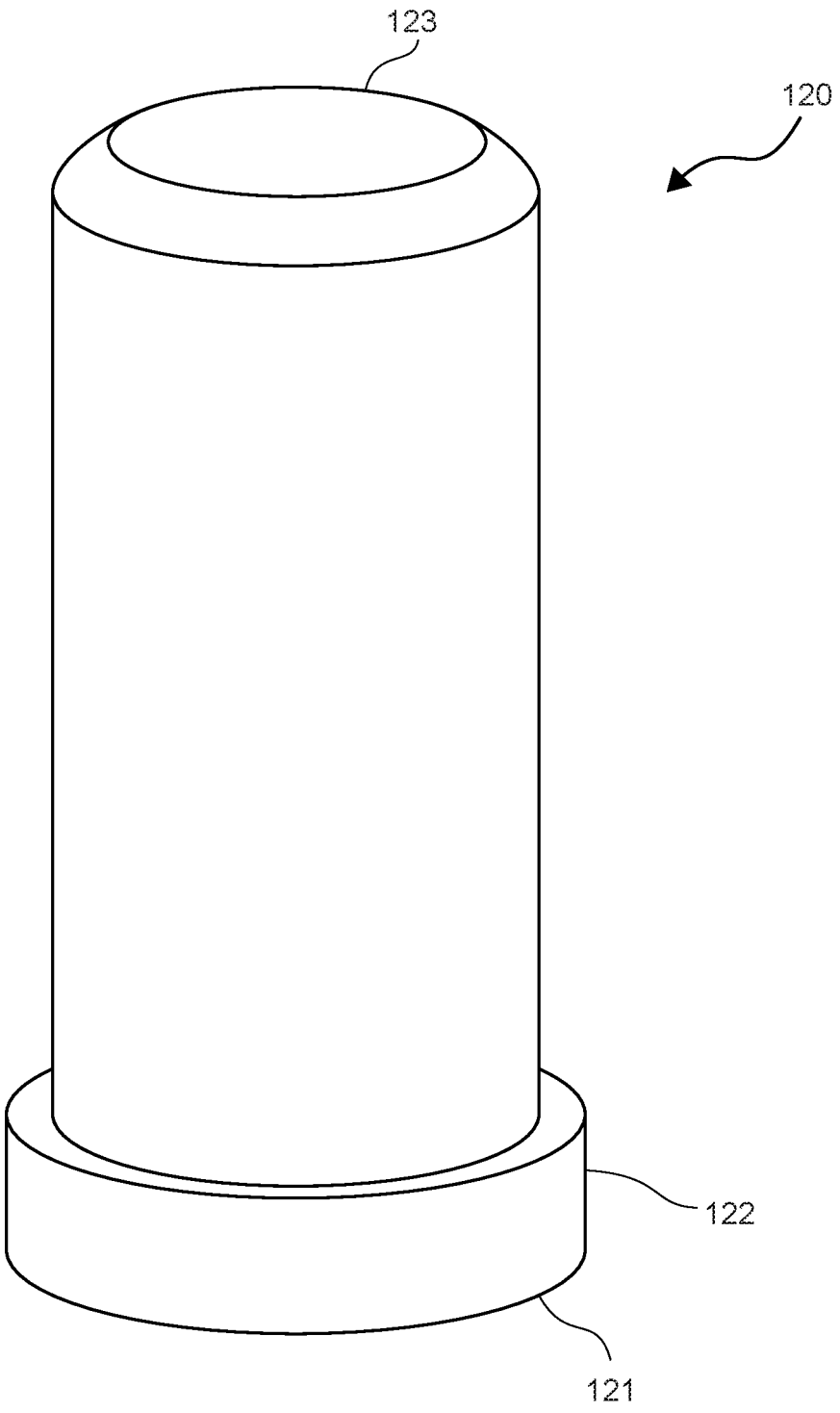
FIG. 2 shows a close-up view of the housing exoskeleton, according to embodiments of the inventive subject matter.

FIG. 2 shows a close-up view of the housing exoskeleton 120. As seen in FIG. 2, the housing exoskeleton 120 has an open end 121 at the rear end dimensioned to fit the electronics component 110. On this same end 121, the housing exoskeleton 120 has a collar 122 extending outwardly from the body of the exoskeleton. The collar 122 is dimensioned such that the rear end of the deceleration sleeve contacts the collar 122, preventing the deceleration sleeve 130 from sliding rearward during the acceleration of the bullet when fired. The front end 123 of the housing exoskeleton is closed and solid, thus helping to protect the electronics component 110.

In embodiments where a deceleration sleeve 130 is not used, the housing exoskeleton 120 does not have the collar 122.

The housing exoskeleton 120 is made from a material that can resist the forces encountered by the bullet 100 during firing and impact to protect the enclosed electronics component 110. Suitable materials include aluminum, stainless steel, and other hard metals or materials. It is also contemplated that polymers can be used for the housing exoskeleton 120.

The thickness and/or the material of the housing exoskeleton 120 can vary depending on factors such as the intended target, the caliber of the ordnance, the weapon deploying the ordnance, and whether a deceleration sleeve 130 is used in the bullet 100. For situations where the impact forces are expected to be greater, the housing exoskeleton 120 has a greater thickness and/or is made from a harder material to offer greater protection to the electronic components 110.

Figure 3:
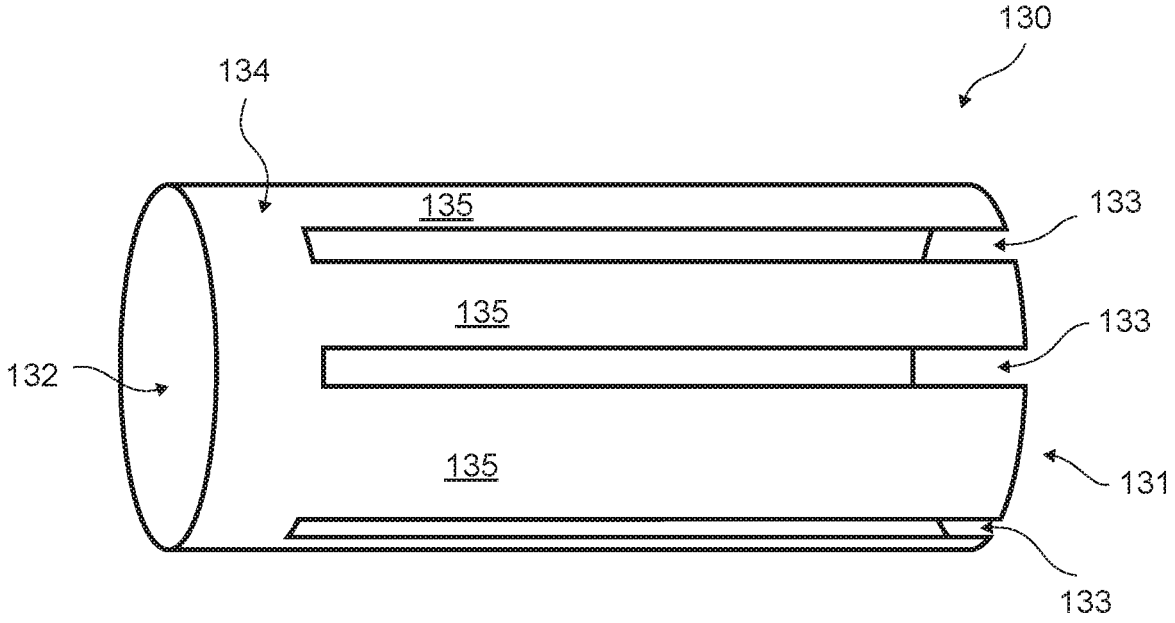
FIG. 3 is a close-up view of the deceleration sleeve of FIG. 1.

FIG. 3 is a close-up view of the deceleration sleeve 130 of FIG. 1. The deceleration sleeve 130 is dimensioned to fit the lead core 160 at a front end 131, and have the housing exoskeleton 120 introduced at a rear end 132 such that the housing exoskeleton 120 is within the deceleration sleeve 130. As noted above, when the bullet is fully assembled, the rear end 132 of the deceleration sleeve 130 abuts the collar 122 of the housing exoskeleton 120, thus preventing the deceleration sleeve 130 from further rearward movement relative to the housing exoskeleton 120 during firing and flight. As seen in FIG. 3, the deceleration sleeve 130 includes a plurality of grooves or perforations 133 extending rearwardly from the front end 131 of the sleeve. Between the grooves 133, the side surface 134 is divided up into deceleration segments 135. In the embodiments shown here, the grooves 133 extend entirely through the side surface 134 of the deceleration sleeve 130. Suitable materials for the deceleration sleeve 130 include aluminum, copper, or other metals with suitable properties. The material should not be too hard or rigid such that the deceleration sleeve 130 is prevented from shearing.

In the embodiments shown here, the grooves 133 extend entirely through the outer side surface 134 of the deceleration sleeve 130. In other embodiments, the grooves 133 may not extend entirely through the outer surface 134 of the sleeve 130 all the way to the inside, but instead be sections of material of a smaller thickness than the regular thickness of the sleeve 130.

Figure 4:
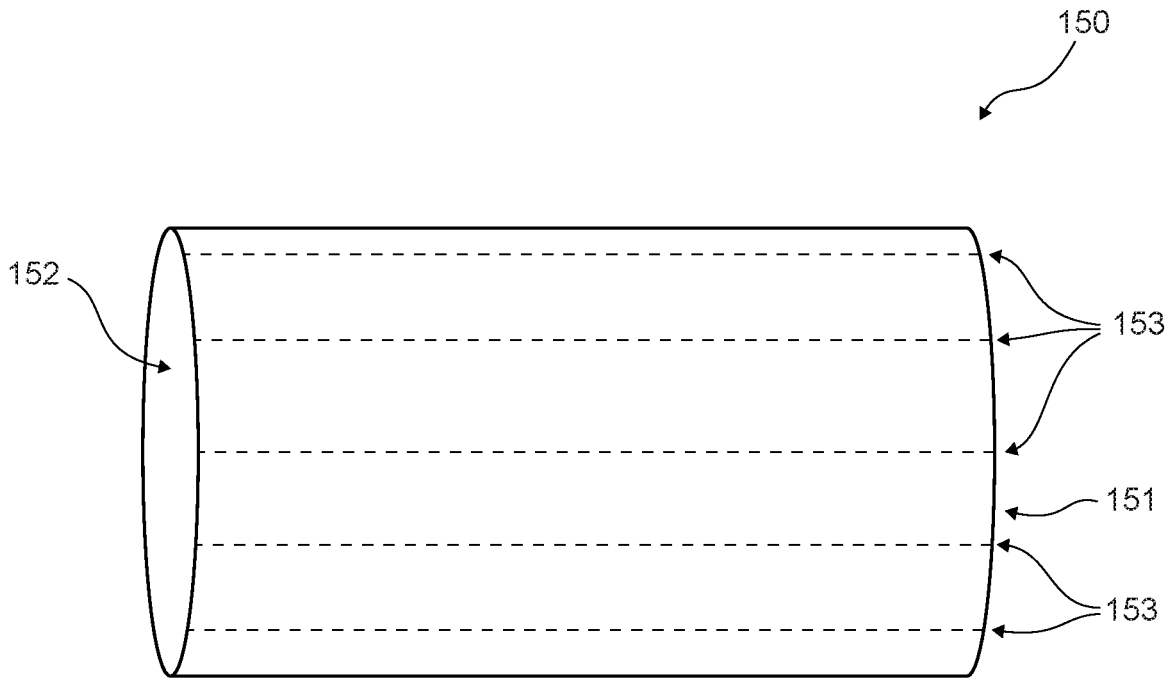
FIG. 4 provides a close-up view of the outer jacket, according to embodiments of the inventive subject matter.

FIG. 4 provides a close-up view of the outer jacket 150. Outer jacket 150 has an opening at a front end 151 and is closed at a rear end 152. Along the length of the side surface, outer jacket 150 has a plurality of serrated lines 153 extending rearwardly from the front end 151. These serrated lines 153 are weaker sections of the outer surface of the jacket 150 that are sufficiently strong to hold the bullet closed during flight, but that fail and cause the jacket 150 to shear away during the impact/deployment procedures as discussed in greater detail below. In the embodiment shown in FIG. 4, the serrated lines 153 extend along the entire length of the side of outer jacket 150. However, in other embodiments, the serrated lines 153 extend rearwardly along the side of outer jacket 150 for a portion of the length.

In embodiments, the serrated lines 153 are disposed on the outer jacket 150 to align with the grooves 133 of the deceleration sleeve 130 when the bullet 100 is assembled. In other embodiments, the serrated lines 153 are not required to be aligned with the grooves 133.

The outer jacket 150 can be made from aluminum, copper or other suitable materials. The material should not be too hard or rigid such that the outer jacket 150 is prevented from shearing.

In embodiments where a deceleration sleeve 130 is not used, the outer jacket 150 is dimensioned to also receive core 160.

Figure 5:
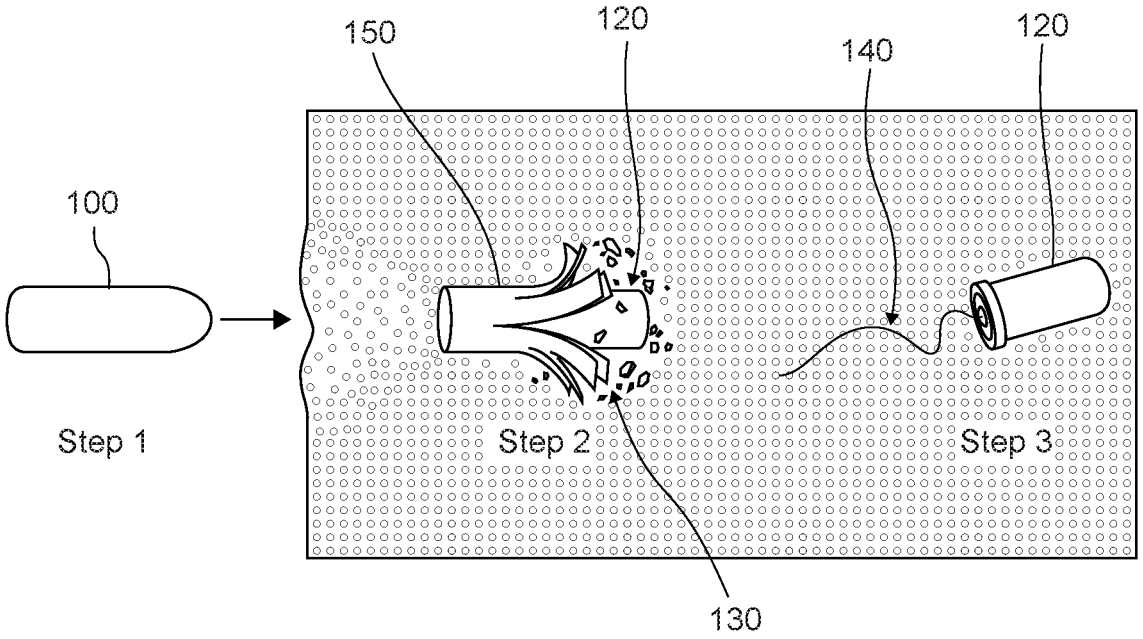
FIG. 5 illustrates the process in which the deceleration sleeve is activated such that the electronics component is delivered within the target, according to embodiments of the inventive subject matter.

FIG. 5 illustrates the process in which the deceleration sleeve 130 and outer jacket 150 are activated such that the electronics component 110 is delivered within the target.

At step 1 of FIG. 4, the bullet 100 has been fired and is in flight.

At step 2, upon impact, the core 160 (e.g., a lead core) expands laterally as it is compressed by the force of the impact. The expanding core 160 causes the segments 135 of deceleration sleeve 130 to begin shearing outward. This also causes the outer jacket 150 to split and fan out along its perforations, which fail due to the forces exerted by the expanding lead core 160. Because the core 160 is not fully encased by either the deceleration sleeve 130 or the outer jacket 150 in the assembly of the bullet 100, it can push both components outward as it flattens causing this fanning effect.

The friction caused by the contact of the fanned-out sections of the deceleration sleeve 130 and outer jacket 150 with the target result in the slowing down of the electronics component 110 within the housing exoskeleton 120. As the deceleration sleeve 130 peels away from the housing exoskeleton 120, the housing exoskeleton 120 with the electronics component 110 is left deployed within the target as shown in step 3.

During the deceleration of step 2, the slowdown caused by the fanning out of the outer jacket 150 causes the jacket 150 to become separated from the housing exoskeleton 120. This causes the antenna 140 to become deployed and begin transmission. In embodiments such as the one discussed in greater detail below, a magnet is used to initiate transmission wherein the separation of the magnet from the proximity of the electronics component 110 causes the initiation of transmission.

The expanding core 160 is illustrated herein as having a conical shape. However, other shapes are contemplated such as hollow points, rounded tip, flat tip, etc.

Figure 6:
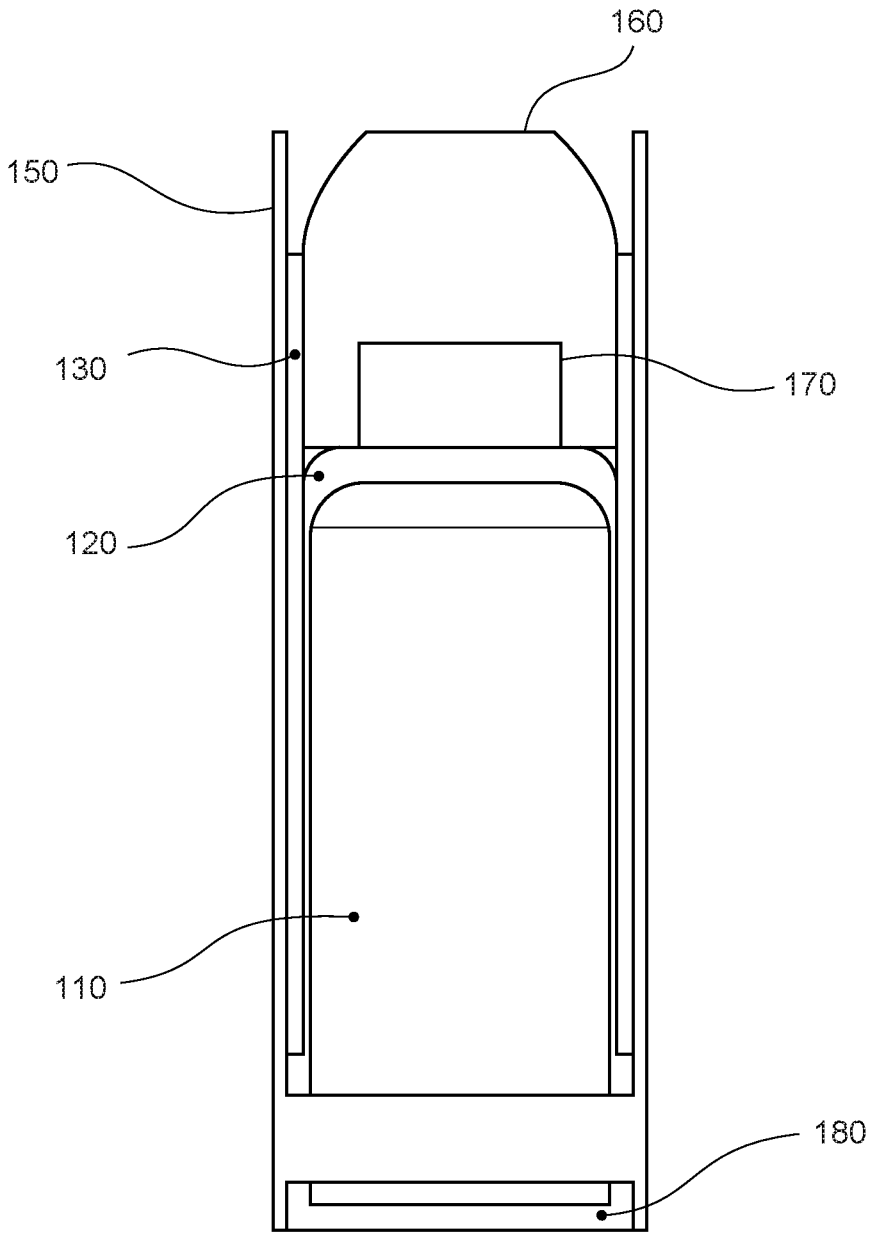
FIG. 6 is a cross-section/cutaway view of an electronics ordnance delivery system that includes a magnet, according to embodiments of the inventive subject matter.

In embodiments such as the one illustrated in FIG. 6 (which is a cross-section/cutaway view), a forward magnet 170 is incorporated into the bullet between the core 160 and the housing exoskeleton 120. The forward magnet 170 is used to hold a switch in electronics component 110 open until deployment within a target such that the electronics component 110 is only powered (and thus activated) when the bullet impacts with a target. Upon impact, the magnet 170 is separated from the housing exoskeleton 120. When the force exerted by the magnet is no longer present due to the separation, the switch within electronics component 110 is closed and the power from a power source (a battery) is provided to the electronics component 110 for function.

In other embodiments, a switch can be used instead of the magnet 170. In these embodiments, the switch is kept open with a mechanism that is separated from the switch upon the separation, similar to the switch. The switch is biased to closed such that when the mechanism is separated from the switch, the switch closes thus completing the circuit and providing power from the power source to the electronics component 110.

It should be noted that the illustration of FIG. 6 is prior to the sealing of the outer jacket 150. To finish the manufacture of the bullet 100, the outer jacket 150 is shaped to follow the front shape of the core 160 and sealed. In the embodiment shown in FIG. 6, the assembly also includes a gas check 180 rearward of the outer jacket 150.

In alternative embodiments of the inventive subject matter, the bullet 100 can be assembled without a deceleration sleeve 130. In these embodiments, the thickness of the housing exoskeleton 120 is increased to provide adequate protection to the electronics component 110. In these embodiments, the front of the bullet can also be modified to assist in slowing the bullet after impact with the target. For example, a hollow-point core 160 (such as a hollow-point lead core) can be used to assist in slowing the bullet after it enters the target.

It is contemplated that the inventive subject matter can be used with bullets of all calibers and sizes (e.g., .50 caliber, .22 caliber, etc.), and with projectiles larger than bullets (e.g., mortars, missiles, grenade launchers-based ordnance, etc.).

As discussed herein, the materials used for the housing exoskeleton 120 and the deceleration sleeve 130 can be selected based on factors such as the caliber of the bullet, the weapon used to deploy the bullet, the intended target, and other factors. Likewise, the physical characteristics of various components (e.g., the thickness of the various parts of the housing exoskeleton 120 and/or deceleration sleeve 130) can similarly be altered according to these factors.

As mentioned above, the electronics component 110 is encased within a potting material. In embodiments, a polymer potting material can be used to not only encase the electronics component 110, but also to replace one or more of the components of the embodiment of FIG. 1. For example, a polymer can be used with a mold to shape the polymer layer to replace the housing exoskeleton 120, and in certain embodiments, also replace the deceleration sleeve 130 and core 160. In still other embodiments, the polymer can be in the shape of the entire bullet such that the outer jacket 150 is also replaced. In these embodiments, the electronics component 110 encased in the polymer bullet is assembled with the powder charge 200 and primer 300 to form the finished cartridge 400.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An electronics ordnance delivery system, comprising:

an electronics component encased within a potting material;

a housing exoskeleton dimensioned to receive the electronics component within the potting material;

an outer jacket dimensioned to fit around the housing exoskeleton, the outer jacket including a plurality of weakened lines along a side surface, the weakened lines extending rearwardly from affront end of the outer jacket, such that the outer jacket fans out along the weakened lines and separates from the housing exoskeleton after the delivery system enters a target; and a core dimensioned to be inserted into a front end of the outer jacket such that a deformation of the core exerts an outward force that causes the fanning of the outer jacket along the weakened lines during entry into the target.

2. The system of claim 1, further comprising a deceleration sleeve dimensioned to receive the housing exoskeleton and fit within the outer jacket, the deceleration sleeve including a plurality of grooves disposed on a side surface and extending rearwardly from a front end of the deceleration sleeve.

3. The system of claim 2, wherein the plurality of weakened lines are disposed on the side surface of the outer jacket such that they align with the plurality of grooves of the deceleration sleeve when the deceleration sleeve is inserted into the outer jacket.

4. The system of claim 2, further comprising a core dimensioned to be inserted into the front end of the deceleration sleeve.

5. The system of claim 1, wherein the core has a rounded tip shape.

6. The system of claim 1, wherein the core has a hollow point tip shape.

7. The system of claim 1, wherein the core has a flat tip shape.

8. The system of claim 1, wherein the core is made from one or more of lead, copper, steel, composite, or copper.

9. The system of claim 1, wherein the housing exoskeleton is made at least in part from aluminum or stainless steel.

10. The system of claim 1, wherein the potting material is a polymer.

11. The system of claim 1, wherein the electronics component comprises a location determination device and a transmitter, and further comprising an antenna communicatively coupled with the transmitter.

12. The system of claim 11, wherein the transmitter is at least one of a WiFi transmitter, a Bluetooth transmitter, an RF transmitter, an NFC transmitter, or a cellular transmitter.

13. The system of claim 1, wherein the weakened lines comprise serrated lines.

* * * * *